US011086243B1

(12) United States Patent
Frank et al.

(10) Patent No.: US 11,086,243 B1
(45) Date of Patent: Aug. 10, 2021

(54) DUAL WAX TONER COMPOSITION

(71) Applicant: Xerox Corporation, Norwalk, CT (US)

(72) Inventors: Jordan A. Frank, Rochester, NY (US); Daniel W. Asarese, Honeoye Falls, NY (US); Paul K. Acquaviva, Penfield, NY (US); Chieh-Min Cheng, Rochester, NY (US); Michael F. Zona, Webster, NY (US); Richard P. N. Veregin, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/800,176

(22) Filed: Feb. 25, 2020

(51) Int. Cl.

| | |
|---|---|
| ***G03G 9/08*** | (2006.01) |
| ***G03G 9/087*** | (2006.01) |
| ***G03G 9/09*** | (2006.01) |
| ***G03G 9/097*** | (2006.01) |

(52) U.S. Cl.
CPC ..... *G03G 9/08782* (2013.01); *G03G 9/08755* (2013.01); *G03G 9/0904* (2013.01); *G03G 9/0906* (2013.01); *G03G 9/09733* (2013.01)

(58) Field of Classification Search
CPC ..... G03G 9/08782; G03G 9/09733; G03G 9/08755
USPC ..... 430/108.8
See application file for complete search history.

(56) References Cited

U.S. PATENT DOCUMENTS

| | | | |
|---|---|---|---|
| 3,590,000 | A | 6/1971 | Palermiti et al. |
| 3,681,106 | A | 8/1972 | Burns et al. |
| 4,298,672 | A | 11/1981 | Lu |
| 4,338,390 | A | 7/1982 | Lu |
| 4,845,006 | A | 7/1989 | Matsubara et al. |
| 4,863,824 | A | 9/1989 | Uchida et al. |
| 4,863,825 | A | 9/1989 | Yoshimoto et al. |
| 4,917,983 | A | 4/1990 | Uchida et al. |
| 4,931,370 | A | 6/1990 | Amaya et al. |
| 4,933,252 | A | 6/1990 | Nishikawa et al. |
| 4,935,326 | A | 6/1990 | Creatura et al. |
| 4,937,166 | A | 6/1990 | Creatura et al. |
| 4,973,539 | A | 11/1990 | Sacripante et al. |
| 4,980,448 | A | 12/1990 | Tajiri et al. |
| 4,981,939 | A | 1/1991 | Matsumura et al. |
| 4,988,794 | A | 1/1991 | Kubo et al. |
| 5,057,596 | A | 10/1991 | Kubo et al. |
| 5,143,809 | A | 9/1992 | Kaneko et al. |
| 5,227,460 | A | 7/1993 | Mahabadi et al. |
| 5,376,494 | A | 12/1994 | Mahabadi et al. |
| 5,480,756 | A | 1/1996 | Mahabadi et al. |
| 5,500,324 | A | 3/1996 | Mahabadi et al. |
| 5,601,960 | A | 2/1997 | Mahabadi et al. |
| 5,629,121 | A | 5/1997 | Nakayama |
| 5,650,484 | A | 7/1997 | Hawkins et al. |
| 5,750,909 | A | 5/1998 | Hawkins et al. |
| 6,063,827 | A | 5/2000 | Sacripante et al. |
| 6,214,507 | B1 | 4/2001 | Sokol et al. |
| 6,326,119 | B1 | 12/2001 | Hollenbaugh, Jr. et al. |
| 6,358,657 | B1 | 3/2002 | Silence et al. |
| 6,359,105 | B1 | 3/2002 | Ianni et al. |
| 6,592,913 | B2 | 7/2003 | Cook et al. |
| 6,593,053 | B1 | 7/2003 | Chang et al. |
| 9,864,291 | B1 * | 1/2018 | Veregin ..... G03G 9/09371 |
| 10,095,143 | B1 | 10/2018 | Veregin et al. |
| 2015/0104742 | A1 * | 4/2015 | Morales-Tirado ... G03G 9/0904 430/108.1 |

OTHER PUBLICATIONS

Richard P. N. Veregin, et al., U.S. Appl. No. 16/800,236, filed Feb. 25, 2020.
Richard P. N. Veregin, et al., U.S. Appl. No. 16/800,118, filed Feb. 25, 2020.

* cited by examiner

*Primary Examiner* — Mark A Chapman
(74) *Attorney, Agent, or Firm* — Marylou J. Lavoie, Esq. LLC

(57) ABSTRACT

A toner composition including a first wax; a second wax that is different from the first wax; wherein the first wax comprises a paraffin wax; wherein the second wax comprises a polymethylene wax; at least one polyester; and an optional colorant.

21 Claims, No Drawings

DUAL WAX TONER COMPOSITION

BACKGROUND

Disclosed herein is a toner composition comprising a first wax; a second wax that is different from the first wax; wherein the first wax comprises a paraffin wax; wherein the second wax comprises a polymethylene wax; at least one polyester; and an optional colorant.

Polyester toners compositions are desirable for toners and toner/developers. The toners desirably meet several requirements of the intended machine including hot offset or release characteristics. Hot offset can be controlled via addition of a release agent such as wax or gel latex. Alternately, release characteristics can be modified by increasing the molecular weight of the toner binder resin. However, this can affect other rheological properties and adversely impact the final printed image quality.

Currently available toners are suitable for their intended purposes. However a need remains for improved toners having acceptable properties including storage, gloss, fusing latitude and hot offset characteristics.

The appropriate components and process aspects of the each of the foregoing U.S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a toner composition comprising a first wax; a second wax that is different from the first wax; wherein the first wax comprises a paraffin wax; wherein the second wax comprises a polymethylene wax; at least one polyester; and an optional colorant.

DETAILED DESCRIPTION

An emulsion aggregation toner comprising dual waxes is provided. The toner provides acceptable storage, gloss, fusing latitude, and hot offset characteristics. The dual wax toner includes a paraffin wax and a polymethylene wax.

In embodiments, a toner composition is provided comprising a first wax; a second wax that is different from the first wax; wherein the first wax comprises a paraffin wax; wherein the second wax comprises a polymethylene wax; at least one polyester; and an optional colorant.

Dual Wax.

The toner compositions herein comprise a first wax and a second wax that is different from the first wax. In embodiments, the first wax is a paraffin wax and the second wax is a polymethylene wax.

In embodiments, the first wax is a paraffin wax, in embodiments having a low onset melting point of greater than about 50° C. or greater than about 60° C. In embodiments, the first wax is a paraffin wax having a peak melting temperature of from about 60 to about 80° C., or from about 70 to about 80° C., or from about 65 to about 75° C. In a particular embodiment, the first wax is a paraffin wax having a low onset melting point of from about 70 to about 75° C.

In a certain embodiment, the first wax is a paraffin wax having an onset melting temperature of greater than about 55° C.

Any suitable or desired paraffin wax can be selected for embodiments herein. In embodiments, the paraffin wax has the peak melting temperature, low onset melting point characteristics, or combination thereof, described herein. In embodiments, the paraffin wax can be selected from the group consisting of BW-422 and BW-436 from Blended Waxes, Inc.; IGI 1245A, IGI 1250A, IGI 1297A, IGI 1266A all from the International Group, Inc.; Indrawax 6062-F, Indrawax 6264-F, Indrawax 6466-F, Indrawax 6668-F, Indrawax 6870-F, Indrawax 7072-F, Indrawax 8070, Indrawax 6062-S 140-144, Indrawax 6062-S all from Industrial Raw Materials LLC, Shell Sarawax SX70 from Alpha Wax, Strahl & Pitsch 434 and 674 paraffin waxes; dispersions of paraffin waxes including CHEMBEAD® 30, CHEMBEAD® 30-AM, PARAFINE 30, PARAFFIN 60, PARAFFIN EMULSION 135-45 FDA, PARAFFIN EMULSION 150-45 FDA, all from BYK Additives & Instruments, and combinations thereof.

In embodiments, the first wax is a paraffin wax having a carbon to oxygen ratio (C/O ratio) of from about 100 to about 200, or from about 50 to about 150, or from about 100 to about 200. In embodiments, the first wax is a paraffin wax having a carbon to oxygen ratio of greater than about 50.

In certain embodiments, the first wax is a paraffin wax having a number-averaged molecular weight of from about 400 grams/mol to 600 grams/mol, or from about 500 grams/mol to 600 grams/mol, or from about 500 grams/mol to about 530 grams/mol.

In embodiments, the second wax is a distilled synthetic polymethylene wax (Fischer-Tropsch) wax with a melting point of about 92° C.

In certain embodiments, the polymethylene wax has a number-averaged molecular weight of from about 600 grams/mol to 800 grams/mol, or from about 600 grams/mol to 700 grams/mol, or from about 670 grams/mol to about 700 grams/mol.

In embodiments, the toner comprises a total amount of wax, including both the paraffin wax and the polymethylene wax, of from about 7 to about 14, or from about 7 to about 10, or from about 9 to about 10 percent, by weight, based upon the total weight of the toner composition. In certain embodiments, the toner composition comprises a total amount of wax including the first wax and the second wax in an amount of from about 9 to about 12 percent by weight based upon the total weight of the toner composition.

In embodiments, the paraffin wax is present in an amount of from about 3 to about 10, or from about 5 to about 9, or from about 6 to about 8 percent, by weight, based upon the total weight of the paraffin wax and the polymethylene wax. In certain embodiments, the paraffin wax is present in an amount of from about 25 to about 75 percent by weight based upon the total weight of the paraffin wax and the polymethylene wax.

In certain embodiments, the paraffin wax and polymethylene wax is present in a ratio of 3:1 paraffin:polymethylene.

Crystalline Resin.

The toners herein include a crystalline polyester. The crystalline resin herein may be a crystalline polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, combina-tions thereof, and the like, including their structural isomers. The aliphatic diol may be, for example, selected in an amount of from about 40 to about 60 mole percent of the resin, from about 42 to about 55 mole percent of the resin, or from about 45 to about 53 mole percent of the resin, and a second diol may be selected in an amount of from about 0 to about 10 mole percent of the resin or from about 1 to 4 mole percent of the resin.

Examples of organic diacids or diesters including vinyl diacids or vinyl diesters selected for the preparation of crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, aphthalene-2,7-dicarboxylic acid, cyclohexane dicarboxylic acid, malonic acid and mesaconic acid, a diester or anhydride thereof. The organic diacid may be selected in an amount of, for example, from about 40 to about 60 mole percent of the resin, from about 42 to about 52 mole percent of the resin, or from about 45 to about 50 mole percent of the resin, and a second diacid can be selected in an amount of from about 0 to about 10 mole percent of the resin.

Polycondensation catalysts which may be utilized in forming crystalline (as well as amorphous) polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly (butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene- decanoate), copoly(ethylene-fumarate)- copoly(ethylene-dodecanoate), copoly(2,2-dimethylpropane-1,3-diol- decanoate)-copoly(nonylene-decanoate), poly(octylene-adipate), and mixtures thereof. Examples of polyamides include poly(ethylene-adipamide), poly(propylene-adipamide), poly(butylene-adipamide), poly (pentylene-adipamide), poly(hexylene-adipamide), poly(octylene-adipamide), poly(ethylene-succinimide), poly(propylene-sebecamide), and mixtures thereof. Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), poly(butylene-succinimide), and mixtures thereof.

In embodiments, the crystalline polyester is of the formula

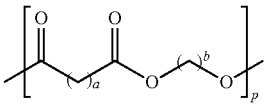

wherein each of a and b may range from 1 to 12, from 2 to 12, or from 4 to 12, and further wherein p may range from 10 to 100, from 20 to 80, or from 30 to 60. In embodiments, the crystalline polyester is poly(1,6-hexylene-1,12-dodecanoate), which may be generated by the reaction of dodecanedioc acid and 1,6-hexanediol.

The designation, "CX:CY," "CX:Y," "X:Y," and forms thereof as used herein describe crystalline resins, wherein C is carbon, X is a positive, non-zero integer identifying the number of methylene groups of the acid/ester monomer used to produce the crystalline polyester (CPE) and Y is a positive, non-zero integer identifying the number of methylene groups of the alcohol monomer used to produce the CPE. Thus, for example, C10 can represent, for example, a dodecanedioic acid and C6 can represent, for example, a hexanediol. X and Y each is 10 or lower. In embodiments, the sum of X and Y is 16 or lower. In certain embodiments, the sum and X and Y is 14 or lower.

In embodiments, the crystalline polyester is a C10:9 resin comprising polyester made from dodecanedioic acid (C10) and 1,9-nonanediol (C9).

As noted above, the crystalline polyesters may be prepared by a polycondensation process by reacting suitable organic diols and suitable organic diacids in the presence of polycondensation catalysts. A stoichiometric equimolar ratio of organic diol and organic diacid may be utilized, however, in some instances where the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized may vary, and can be selected in amounts, such as for example, from about 0.01 to about 1 or from about 0.1 to about 0.75 mole percent of the crystalline polyester resin.

The crystalline resin may be present in the toner in any suitable or desired amount. In embodiments, the crystalline resin may be present, for example, in an amount of from about 1% to about 85% by weight of the toner, from about 5% to about 50% by weight of the toner, or from about 10% to about 35% by weight of the toner. In certain embodiments, the crystalline polyester is present in an amount of from about 6 to about 7 percent by weight based upon the total weight of the toner composition. In certain embodiments, the crystalline polyester is a C10:9 resin which is present in the toner an amount of from about 6 to about 7 percent by weight based upon the total weight of the toner composition.

The crystalline resin can possess various melting points of, for example, from about 30° C. to about 120° C., from about 50° C. to about 90° C. or from about 60° C. to about 80° C. The crystalline resin may have a number average molecular weight (Mn), as measured by gel permeation chromatography (GPC) of, for example, from about 1,000 to about 50,000, from about 2,000 to about 25,000, or from about 5,000 to about 20,000, and a weight average molecular weight (Mw) of, for example, from about 2,000 to about 100,000, from about 3,000 to about 80,000, or from about 10,000 to about 30,000, as determined by GPC. The molecular weight distribution (Mw/Mn) of the crystalline resin may be, for example, from about 2 to about 6, from about 3 to 15 about 5, or from about 2 to about 4.

Amorphous Resin.

In embodiments, the toner compositions comprise at least one amorphous polyester. In embodiments, the toner compositions comprise at least one amorphous polyester and at least one crystalline polyester. In certain embodiments, the at least one polyester comprises a first amorphous polyester and a second amorphous polyester that is different from the first amorphous polyester. In further embodiments, the at least one polyester in the toner comprises a first amorphous polyester and a second amorphous polyester that is different from the first amorphous polyester, and a crystalline polyester.

The amorphous resin may be an amorphous polyester resin formed by reacting a diol with a diacid in the presence of an optional catalyst. Examples of diacids or diesters including vinyl diacids or vinyl diesters utilized for the preparation of amorphous polyesters and include dicarboxylic acids or diesters such as terephthalic acid, phthalic acid, isophthalic acid, fumaric acid, trimellitic acid, dimethyl fumarate, dimethyl itaconate, cis-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, from about 42 to about 52 mole percent of the resin, or from about 45 to about 50 mole percent of the resin.

Examples of diols which may be utilized in generating an amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected may vary, for example, the organic diols may be present in an amount from about 40 to about 60 mole percent of the resin, from about 42 to about 55 mole percent of the resin, or from about 45 to about 53 mole percent of the resin.

Examples of suitable amorphous resins include polyesters, polyamides, polyimides, polyolefins, polyethylene, polybutylene, polyisobutyrate, ethylene-propylene copolymers, ethylene-vinyl acetate copolymers, olypropylene, and the like, and mixtures thereof.

An unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

A suitable polyester resin may be an amorphous polyester such as a poly(propoxylated bisphenol A co-fumarate) resin. Examples of such resins and processes for their production include those disclosed in U.S. Pat. No. 6,063,827, the disclosure of which is hereby incorporated by reference in its entirety.

Suitable polyester resins include amorphous acidic polyester resins. An amorphous acid polyester resin may be based on any combination of propoxylated bisphenol A, ethoxylated bisphenol A, terephthalic acid, fumaric acid, and dodecenyl succinic anhydride, such as poly(propoxylated bisphenol-co-terephthlate-fumarate-dodecenylsuccinate). Another amorphous acid polyester resin which may be used is poly(propoxylated-ethoxylated bisphenol-co-terephthalate-dodecenylsuccinate-trimellitic anhydride).

An example of a linear propoxylated bisphenol A fumarate resin which may be utilized as a resin is available under the trade name SPAMII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

An amorphous resin or combination of amorphous resins may be present, for example, in an amount of from about 5% to about 95% by weight of the toner, from about 30% to about 90% by weight of the toner, or from about 35% to about 85% by weight of the toner.

In embodiments, the toner composition comprises amorphous polyester in an amount of from about 73 to about 78 percent by weight based upon the total weight of the toner composition. In certain embodiments, the toner composition comprises a first amorphous polyester and a second amorphous polyester that is different from the first amorphous polyester, and the total amount of amorphous polyester including both the first and second amorphous polyester is from about 73 to about 78 percent by weight based upon the total weight of the toner composition.

The amorphous resin or combination of amorphous resins may have a glass transition temperature of from about 30° C. to about 80° C., from about 35° C. to about 70° C., or from about 40° C. to about 65° C. The glass transition temperature may be measured using differential scanning calorimetry (DSC). The amorphous resin may have a Mn as measured by GPC of, for example, from about 1,000 to about 50,000, from about 2,000 to about 25,000, or from about 1,000 to about 10,000, and a Mw of, for example, from about 2,000 to about 100,000, from about 5,000 to about 90,000, from about 10,000 to about 90,000, from about 10,000 to about 30,000, or from about 70,000 to about 100,000, as determined by GPC.

In embodiments, one, two, or more resins may be used. Where two or more resins are used, the resins may be in any suitable ratio (e.g., weight ratio) such as for instance, of from about 1% (first resin)/99% (second resin) to about 99% (first resin)/1% (second resin), from about 10% (first resin)/90% (second resin) to about 90% (first resin)/10% (second resin). Where the resins include a combination of amorphous and crystal line resins, the resins may be in a weight ratio of, for example, from about 1% (crystalline resin)/99% (amorphous resin) to about 99% (crystalline resin)/1% (amorphous resin), or from about 10% (crystalline resin)/90% (amorphous resin) to about 90% (crystalline resin)/10% (amorphous resin). In some embodiments, the weight ratio of the resins is from about 80% to about 60% of the amorphous resin and from about 20% to about 40% of the crystalline resin. In such embodiments, the amorphous resin may be a combination of amorphous resins, e.g., a combination of two amorphous resins.

In embodiments, the toner comprises a core-shell configuration wherein the core comprises at least one amorphous polyester and at least one crystalline polyester; and wherein the shell comprises at least one amorphous polyester.

In other embodiments, the toner comprises a core-shell configuration wherein the core comprises at least one amorphous polyester and at least one crystalline polyester; and wherein the shell comprises a first amorphous polyester and a second amorphous polyester that is different from the first amorphous polyester.

In other embodiments, the toner comprises a core-shell configuration wherein the core comprises a first amorphous polyester comprising a poly(propoxylated bisphenol-co-terephthalate-fumarate-dodecenylsuccinate) and a second amorphous polyester comprising a poly(propoxylated-ethoxylated bisphenol-co-terephthalate-dodecenylsuccinate-trimellitic anhydride).

In embodiments, the toner core further comprises a third amorphous polyester resin and a fourth amorphous polyester resin. In embodiments, the third and fourth amorphous polyester resin are different. In embodiments, the third amorphous polyester resin is present in an amount of from about 1 to about 20, or from about 3 to about 18, or from about 5 to about 15 percent by weight, based upon the total weight of the toner. In embodiments, the fourth amorphous polyester resin is present in an amount of from about 1 to about 20, or from about 3 to about 18, or from about 5 to about 15 percent by weight, based upon the total weight of the toner. In certain embodiments, the third amorphous polyester is a poly(propoxylated bisphenol-co-terephthalate-fumarate-dodecenylsuccinate) and the fourth amorphous polyester is a poly(propoxylated-ethoxylated bisphenol-co-terephthalate-dodecenylsuccinate-trimellitic anhydride).

In embodiments, the third amorphous polyester resin and the fourth amorphous polyester resin are present in the toner core in equal amounts.

In certain embodiments, the toner comprises a core-shell configuration wherein the shell comprises a resin and wherein the shell resin comprises about 28 percent by weight of the toner composition based upon the total weight of the toner composition including the core and shell. The shell resin or resins comprising the 28 percent of the toner can be selected from any of the resins described herein. In embodiments, the shell resin comprises 28 percent of the toner particle mass, in embodiments where the shell resin comprises a combination of two different amorphous polyesters, in embodiments, where the shell comprises a combination of a low molecular weight amorphous polyester and a high molecular weight amorphous polyester.

In embodiments, the amorphous resin may include at least one low molecular weight amorphous polyester resin. The low molecular weight amorphous polyester resins, which are available from a number of sources, can possess various melting points of, for example, from about 30° C. to about 120° C., in embodiments from about 75° C. to about 115° C., in embodiments from about 100° C. to about 110° C., or in embodiments from about 104° C. to about 108° C. As used herein, the low molecular weight amorphous polyester resin has, for example, a number average molecular weight (Mn), as measured by gel permeation chromatography (GPC) of, for example, from about 1,000 to about 10,000, in embodiments from about 2,000 to about 8,000, in embodiments from about 3,000 to about 7,000, and in embodiments from about 4,000 to about 6,000. The weight average molecular weight (Mw) of the resin is 50,000 or less, for example, in embodiments from about 2,000 to about 50,000, in embodiments from about 3,000 to about 40,000, in embodiments from about 10,000 to about 30,000, and in embodiments from about 18,000 to about 21,000, as determined by GPC using polystyrene standards. The molecular weight distribution (Mw/Mn) of the low molecular weight amorphous resin is, for example, from about 2 to about 6, in embodiments from about 3 to about 4. The low molecular weight amorphous polyester resins may have an acid value of from about 8 to about 20 mg KOH/g, in embodiments from about 9 to about 16 mg KOH/g, and in embodiments from about 10 to about 14 mg KOH/g.

In embodiments, a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

As used herein, the high molecular weight amorphous polyester resin may have, for example, a number average molecular weight (Mn), as measured by gel permeation chromatography (GPC) of, for example, from about 1,000 to about 10,000, in embodiments from about 2,000 to about 9,000, in embodiments from about 3,000 to about 8,000, and in embodiments from about 6,000 to about 7,000. The weight average molecular weight (Mw) of the resin is greater than 55,000, for example, from about 55,000 to about 150,000, in embodiments from about 60,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight (Mw) and the number-average molecular weight (Mn). The low molecular weight amorphous polyester resins may have an acid value of from about 8 to about 20 mg KOH/g, in embodiments from about 9 to about 16 mg KOH/g, and in embodiments from about 11 to about 15 mg KOH/g. The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 121° C.

The high molecular weight amorphous resins, which are available from a number of sources, can possess various onset glass transition temperatures (Tg) of, for example, from about 40° C. to about 80° C., in embodiments from about 50° C. to about 70° C., and in embodiments from about 54° C. to about 68° C., as measured by differential scanning calorimetry (DSC). The linear and branched amorphous polyester resins, in embodiments, may be a saturated or unsaturated resin.

The high molecular weight amorphous polyester resins may be prepared by branching or cross-linking linear polyester resins. Branching agents can be utilized, such as trifunctional or multifunctional monomers, which agents usually increase the molecular weight and polydispersity of the polyester. Suitable branching agents include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S. Pat. Nos. 4,863,825; 4,863,824; 4,845,006; 5,143,809; 5,057,596; 4,988,794; 4,981,939; 4,980,448; 4,933,252; 4,931,370; 4,917,983, and 4,973,539, the disclosures of each of which are incorporated by reference herein in their entirety.

In embodiments, cross-linked polyesters resins may be made from linear amorphous polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference herein in their entirety. In embodiments, suitable unsaturated polyester base resins may be prepared from diacids and/or anhydrides such as, for example, maleic anhydride, terephthalic acid, trimellitic acid, fumaric acid, and the like, and combinations thereof, and diols such as, for example, bisphenol-A ethylene oxide adducts, bisphenol A-propylene oxide adducts, and the like, and combinations thereof. In embodiments, a suitable polyester is poly(propoxylated bisphenol A co-fumaric acid).

In embodiments, a cross-linked branched polyester may be utilized as a high molecular weight amorphous polyester resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof, or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin. Examples of such polyesters and methods for their synthesis include those disclosed in U.S. Pat. No. 6,592,913, the disclosure of which is hereby incorporated by reference herein in its entirety.

Suitable polyols may contain from about 2 to about 100 carbon atoms and have at least two or more hydroxyl groups, or esters thereof. Polyols may include glycerol, pentaerythritol, polyglycol, polyglycerol, and the like, or mixtures thereof. The polyol may include a glycerol. Suitable esters of glycerol include glycerol palmitate, glycerol sebacate, glycerol adipate, triacetin tripropionin, and the like. The polyol may be present in an amount of from about 20% to about 30% by weight of the reaction mixture, in embodiments, from about 22% to about 26% by weight of the reaction mixture.

Aliphatic polyfunctional acids having at least two functional groups may include saturated and unsaturated acids containing from about 2 to about 100 carbon atoms, or esters thereof, in some embodiments, from about 4 to about 20 carbon atoms. Other aliphatic polyfunctional acids include malonic, succinic, tartaric, malic, citric, fumaric, glutaric, adipic, pimelic, sebacic, suberic, azelaic, sebacic, and the like, or mixtures thereof. Other aliphatic polyfunctional acids which may be utilized include dicarboxylic acids containing a C3 to C6 cyclic structure and positional isomers thereof, and include cyclohexane dicarboxylic acid, cyclobutane dicarboxylic acid or cyclopropane dicarboxylic acid.

Aromatic polyfunctional acids having at least two functional groups which may be utilized include terephthalic, isophthalic, trimellitic, pyromellitic and naphthalene 1,4-, 2,3-, and 2,6-dicarboxylic acids.

The aliphatic polyfunctional acid or aromatic polyfunctional acid may be present in an amount of from about 40% to about 65% by weight of the reaction mixture, in embodiments, from about 44% to about 60% by weight of the reaction mixture.

Long chain aliphatic carboxylic acids or aromatic monocarboxylic acids may include those containing from about 12 to about 26 carbon atoms, or esters thereof, in embodiments, from about 14 to about 18 carbon atoms. Long chain aliphatic carboxylic acids may be saturated or unsaturated. Suitable saturated long chain aliphatic carboxylic acids may include lauric, myristic, palmitic, stearic, arachidic, cerotic, and the like, or combinations thereof. Suitable unsaturated long chain aliphatic carboxylic acids may include dodecylenic, palmitoleic, oleic, linoleic, linolenic, erucic, and the like, or combinations thereof. Aromatic monocarboxylic acids may include benzoic, naphthoic, and substituted naphthoic acids. Suitable substituted naphthoic acids may include naphthoic acids substituted with linear or branched alkyl groups containing from about 1 to about 6 carbon atoms such as 1-methyl-2 naphthoic acid and/or 2-isopropyl-1-naphthoic acid. The long chain aliphatic carboxylic acid or aromatic monocarboxylic acids may be present in an amount of from about 0% to about 70% weight of the reaction mixture, in embodiments, of from about 15% to about 30% weight of the reaction mixture.

Additional polyols, ionic species, oligomers, or derivatives thereof, may be used if desired. These additional glycols or polyols may be present in amounts of from about 0% to about 50% weight percent of the reaction mixture. Additional polyols or their derivatives thereof may include propylene glycol, 1,3-butanediol, 1,3-propanediol, 1,4-butanediol, 1,6-hexanediol diethylene glycol, 1,4-cyclohexanediol, 1,4-cyclohexanedimethanol, neopentyl glycol, triacetin, trimethylolpropane, pentaerythritol, cellulose ethers, cellulose esters, such as cellulose acetate, sucrose acetate iso-butyrate and the like.

In embodiments, the cross-linked branched polyesters for the high molecular weight amorphous polyester resin may include those resulting from the reaction of dimethylterephthalate, 1,3-butanediol, 1,2-propanediol, and pentaerythritol.

In embodiments, the high molecular weight resin, for example a branched polyester, may be present on the surface of toner particles of the present disclosure. The high molecular weight resin on the surface of the toner particles may also be particulate in nature, with high molecular weight resin particles having a diameter of from about 100 nanometers to about 300 nanometers, in embodiments from about 110 nanometers to about 150 nanometers.

The amount of high molecular weight amorphous polyester resin in a toner particle of the present disclosure, whether in any core, any shell, or both, may be from about 25% to about 50% by weight of the toner, in embodiments from about 30% to about 45% by weight, in other embodiments or from about 40% to about 43% by weight of the toner (that is, toner particles exclusive of external additives and water).

The ratio of crystalline resin to the low molecular weight amorphous resin to high molecular weight amorphous polyester resin can be in the range from about 1:1:98 to about 98:1:1 to about 1:98:1, in embodiments from about 1:5:5 to about 1:9:9, in embodiments from about 1:6:6 to about 1:8:8.

The resin(s) in the present toners may possess acid groups which may be present at the terminal of the resin. Acid groups which may be resent include carboxylic acid groups, and the like. The number of carboxylic acid groups may be controlled by adjusting the materials utilized to form the resin and reaction conditions. In embodiments, the resin is a polyester resin having an acid number from about 2 mg KOH/g of resin to about 200 mg KOH/g of resin, from about 5 mg KOH/g of resin to about 50 mg KOH/g of resin, or from about 5 mg KOH/g of resin to about 15 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

Colorant.

The toners may optionally contain a colorant. Any suitable or desired colorant can be selected. In embodiments, the colorant can be a pigment, a dye, mixtures of pigments and dyes, mixtures of pigments, mixtures of dyes, and the like. For simplicity, the term "colorant" when used herein is meant to encompass such colorants, dyes, pigments, and mixtures unless specified as a particular pigment or other colorant component. In embodiments, the colorant comprises a pigment, a dye, mixtures thereof, in embodiments, carbon black, magnetite, black, cyan, magenta, yellow, red, green, blue, brown, mixtures thereof, in an amount of from about 1 percent to about 25 percent by weight based upon the total weight of the toner composition. In embodiments, the colorant is selected from cyan, magenta, yellow, black, or a combination thereof. In certain embodiments, the colorant comprises a combination of carbon black and cyan. It is to be understood that other useful colorants will become readily apparent based on the present disclosure.

In certain embodiments, the colorant comprises pigment present in an amount of from about 5 to about 8 percent by weight based upon the total weight of the toner composition.

Useful colorants include Paliogen® Violet 5100 and 5890 (BASF), Normandy Magenta RD-2400 (Paul Uhlrich), Permanent Violet VT2645 (Paul Uhlrich), Heliogen® Green L8730 (BASF), Argyle Green XP-111-S (Paul Uhlrich), Brilliant Green Toner GR 0991 (Paul Uhlrich), Lithol® Scarlet D3700 (BASF), Toluidine Red (Aldrich), Scarlet for Thermoplast NSD Red (Aldrich), Lithol® Rubine Toner (Paul Uhlrich), Lithol® Scarlet 4440, NBD 3700 (BASF), Bon Red C (Dominion Color), Royal Brilliant Red RD-8192 (Paul Uhlrich), Oracet® Pink RF (Ciba Geigy), Paliogen® Red 3340 and 3871K (BASF), Lithol® Fast Scarlet L4300 (BASF), Heliogen® Blue D6840, D7080, K7090, K6910, and L7020 (BASF), Sudan Blue OS (BASF), Neopen® Blue FF4012 (BASF), PV Fast Blue B2G01 (American Hoechst), Irgalite® Blue BCA (Ciba Geigy), Paliogen® Blue6470 (BASF), Sudan II, III, and IV (Matheson, Coleman, Bell), Sudan Orange (Aldrich), Sudan Orane 220 (BASF), Paliogen® Orange 3040 (BASF), Ortho Orange OR 2673 (Paul Uhlrich), Paliogen® Yellow 152 and 1560 (BASF), Lithol® Fast Yellow 0991K (BASF), Paliotol® Yellow 1840 (BASF), Novaperm® Yellow FGL (Hoechst), Permanent Yellow YE 0305 (Paul Uhlrich), Lumogen® Yellow 00790 (BASF), Suco-Gelb 1250 (BASF), Suco-Yellow D1355 (BASF), Suco Fast Yellow D1165, D1355, and D1351 (BASF), Hostaperm® Pink E (Hoechst), Fanal® Pink D4830 (BASF), Cinquasia® Magenta (DuPont), Paliogen® BlackL9984 (BASF), Pigment Black K801 (BASF), and particularly carbon blacks such as REGAL® 330 (Cabot), Carbon Black 5250 and 5750 (Columbian Chemicals), and the like, or mixtures thereof.

Additional useful colorants include pigments in water based dispersions such as those commercially available from Sun Chemical, for example, SUNSPERSE® BHD 6011X (Blue 15 Type), SUNSPERSE® BHD 9312X (Pigment Blue 15 74160), SUNSPERSE® BHD 6000X (Pigment Blue 15:3 74160), SUNSPERSE® GHD 9600X and GHD 6004X (Pigment Green 7 74260), SUNSPERSE® QHD 6040 X (Pigment Red 122 73915), SUNSPERSE® RHD 9668X (Pigment Red 185 12516), SUNSPERSE® RHD 9365X and 9504X (Pigment Red 57 15850:1), SUNSPERSE® YHD 6005X (Pigment Yellow 83 21108), FLEXIVERSE® YFD 4249 (Pigment Yellow 17 21105), SUNSPERSE® YHD 6020X and 6045X (Pigment Yellow 74 11741), SUNSPERSE® YHD 600X and 9604X (Pigment Yellow 14 21095), FLEXIVERSE® LFD 4343 and LFD 9736 (Pigment Black 7 77226), and the like, or mixtures thereof. Other useful water based colorant dispersions include those commercially available from Clariant, for example, HOSTAFINE® Yellow GR, HOSTAFINE® Black T and Black TS, HOSTAFINE® Blue B2G, HOSTAFINE® Rubine F6B, and magenta dry pigment such as Toner Magenta 6BVP2213 and Toner Magenta E02 which can be dispersed in water and/or surfactant prior to use.

Other useful colorants include magnetites, such as Mobay magnetites M08029, M98960, Columbian magnetites, MAPICO® BLACKS, and surface treated magnetites; Pfizer magnetites CB4799, CB5300, CB5600, MXC6369, Bayer magnetites, BAYFERROX® 8600, 8610; Northern Pigments magnetites, NP-604, NP-608; Magnox magnetites TMB-100 or TMB-104; and the like or mixtures thereof. Additional examples of pigments include phthalocyanine HELIOGEN® BLUE L6900, D6840, D7080, D7020, PYLAM® OIL BLUE, PYLAM® OIL YELLOW, PIGMENT BLUE 1 available from Paul Uhlrich & Company, Inc., PIGMENT VIOLET 1, PIGMENT RED 48, LEMON CHROME YELLOW DCC 1026, ED. TOLUIDINE RED, AND BON RED C available from Dominion Color Corporation, Ltd., Toronto, Ontario, NOVAPERM® YELLOW FGL, HOSTAPERM® PINK E from Hoechst, and CINQUASIA® MAGENTA (DuPont), and the like. Examples of magentas include 2,9-dimethyl substituted quinacridone and anthraquinone dye identified in the Color Index as CI 60710, CI Dispersed Red 15, diazo dye identified in the Color Index as CI 26050, CI Solvent Red 19, and the like, or mixtures thereof. Examples of cyans include copper tetra(octadecyl sulfonamide) phthalocyanine, x-copper phthalocyanine pigment listed in the Color Index as CI 74160, CI Pigment Blue, and Anthrathrene Blue identified in the Color Index as DI 69810, Special Blue X-2137, and the like, or mixtures thereof. Illustrative examples of yellows that may be selected include diarylide yellow 3,3-dichlorobenzidene acetoacetanilides, a monoazo pigment identified in the Color Index ad CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,4-dimethoxy acetoacetanilide, and Permanent Yellow FGL. Colored magnetites, such as mixtures of MAPICO® BLACK and cyan components may also be selected as pigments.

The colorant, such as carbon black, cyan, magenta, and/or yellow colorant, is incorporated in an amount sufficient to impart the desired color to the toner. In general, pigment or dye is employed in an amount of from about 1 percent to about 35 percent, or from about 5 percent to about 25 percent, or from about 5 percent to about 15 percent, by weight of the toner particles on a solids basis. However, amounts outside of these ranges can also be used.

In embodiments, the toner includes a carbon black colorant. Certain emulsion aggregation toners include NIPex® 35 a non-oxidized, low structure furnace black, while other emulsion aggregation toners use Regal® 330. In order to enable as low as possible dielectric loss, a low conductivity carbon black such as the NIPex® 35 is selected. Since carbon black is a semi-conductor, it is desirable to keep the carbon black as pure as possible. Heteroatoms such as oxygen and sulfur dope the carbon black semi-conductor, increasing the conductivity. NIPex® 35 has very high carbon content on the surface as determined by XPS, >99.5%, and very low At % of O and S, <0.5% total. Since the carbon black is very pure, and has very little of the very strong dopants oxygen and sulfur on the surface, the conductivity is very low. This provides lower dielectric loss than with a less pure carbon black, such as Regal® 330, which has >1% oxygen and sulfur. The difference in the purity is most dramatically shown by the carbon:oxygen ratio of the carbon black, which is 499:1 for NIPex® 35, compared to 139:1 for Regal® 330.

In embodiments, the colorant comprises a combination of carbon black and cyan, in embodiments, cyan PB 15:3.

In embodiments, the toner comprises 5 to 8 percent by weight pigment. In certain embodiments, the toner comprises 5 to 8 percent by weight pigment, wherein the pigment comprises a combination of carbon black and cyan, 73 to 78 percent by weight amorphous polyester, wherein the amorphous polyester comprises a first amorphous polyester and a second amorphous polyester that is different from the first amorphous polyester, 6 to 7 percent by weight crystalline polyester, in embodiments wherein the crystalline polyester is a C10:C9 crystalline polyester, where percent by weight is based on the total weight of the toner compositions. In embodiments, the toner comprises a cyan pigment present at about 1 percent by weight and a carbon black pigment present in an amount of about 6.9 percent by weight, based upon the total weight of the toner composition.

In other embodiments, the toner comprises a colorant comprising a combination of two or more of cyan, in embodiments cyan PB 15:3, magenta, in embodiments, one or both of magenta PR269 and magenta RE05, yellow, in embodiments, yellow PY74, and carbon black. In other embodiments, the toner comprises 5 to 8 percent pigment comprising a combination of two or more of cyan, in embodiments cyan PB 15:3, magenta, in embodiments, one or both of magenta PR269 and magenta RE05, yellow, in embodiments, yellow PY74, and carbon black.

Optional Additives.

The toner particles can also contain other optional additives as desired. For example, the toner can include positive or negative charge control agents in any desired or effective amount, in embodiments, in an amount of at least about 0.1 percent by weight of the toner, or at least about 1 percent by weight or the toner, or no more than about 10 percent by weight of the toner, or no more than about 3 percent by weight of the toner. Examples of suitable charge control agents include, but are not limited to, quaternary ammonium compounds such as alkyl pyridinium halides, bisulfates, alkyl pyridinium compounds, including those disclosed in U.S. Pat. No. 4,298,672, which is hereby incorporated by reference herein in its entirety; organic sulfate and sulfonate compositions, including those disclosed in U.S. Pat. No. 4,338,390, which is hereby incorporated by reference herein in its entirety; cetylpyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in embodiments, in an amount of at least about 0.1 percent by weight of the toner, or at least about 0.25 percent by weight of the toner, or no more than about 5 percent by weight of the toner, or no more than about 3 percent by weight of the toner. Suitable additives include, but are not limited to, those disclosed in U.S. Pat. Nos. 3,590,000 and 6,214,507, each of which are hereby incorporated by reference herein in their entireties. These additives can be applied simultaneously with the shell resin or after application of the shell resin.

Emulsion aggregation polyester toners commonly employ about 7.2 parts per hundred (pph) TaycaPower B2060 surfactant, a sodium salt of dodecylbenzene sulphonate as the dispersant for NIPex® carbon black dispersion in the toner.

In embodiments, the amount of TaycaPower surfactant can be reduced in the pigment dispersion to only 2 pph, while adding 3.2 pph of DEMOL SN-B, which is a polymeric surfactant of butyl naphthalene sulfonic acid/2-naphthalene sulfonic acid/formaldehyde, sodium salt (Kao Corporation). The dispersion can then be used in making the toners.

Similar products can be used to reduce dielectric loss. For example: DEMOL M, a sodium arylsulfonate formaldehyde condensate powder, DEMOL SS-L, a sodium arylsulfonate formaldehyde condensate, DEMOL N, DEMOL RN, DEMOL T and DEMOL T-45 sodium naphthalene sulfonate formaldehyde condensates powder, DEMOL NL a sodium naphthalene sulfonate formaldehyde condensates liquid. Other manufacturers provide similar sulphonate formaldehyde condensates such as 1-Naphthalenesulfonic acid, formaldehyde polymer, sodium salt CAS NO. 32844-36-3 available from Anyang Double Circle Auxiliary Co., LTD (China) and sodium naphthalene sulfonate formaldehyde CAS NO. 9084-06-4 available from Chemtrade International (China).

Coagulant.

The toners herein may also contain a coagulant, such as a monovalent metal coagulant, a divalent metal coagulant, a polyion coagulant, or the like. A variety of coagulants are known in the art. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds, in embodiments, may have from about 2 to about 13, or from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from about 0 to about 5 percent, or from about greater than 0 to about 3 percent, by weight of the toner particles.

Surfactant.

In preparing the toner by the emulsion aggregation procedure, one or more surfactants may be used in the process. Suitable surfactants include anionic, cationic, and non-ionic surfactants. In embodiments, the use of anionic and non-ionic surfactants are preferred to help stabilize the aggregation process in the presence of the coagulant, which other could lead to aggregation instability.

Anionic surfactants include sodium dodecylsulfate (SDS), sodium dodecyl benzene sulfonate, sodium dodecylnaphthalene sulfate, dialkyl benzenealkyl sulfates and sulfonates, abietic acid, and the NEOGEN® brand of anionic surfactants. An example of a suitable anionic surfactant is NEOGEN® RK available from Daiichi Kogyo Seiyaku co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, ethyl pyridinium bromide, C12, C15, C17 trimethyl ammonium bromides, halide salts of quaternized polyoxyethylalkylamines, dodecyl benzyl triethyl ammonium chloride. MIRAPOL® and ALKAQUAT® available from Alkaril Chemical Company, SANISOL® (benzalkonium chloride) available from Kao Chemicals, and the like. An example of a suitable cationic surfactant is SANISOL® B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxytheylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL® CA-210, IGEPAL® CA-520, IGEPAL® CA-720, IGEPAL® CO-890, IGEPAL® CO-720, IGEPAL® CO-290, IGEPAL® CA-210, ANTAROX® 890 and ANTAROX® 897. An example of a suitable nonionic surfactant is ANTAROX® 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide, and the like, among others.

Examples of the acids that can be used include, for example, nitric acid, sulfuric acid, hydrochloric acid, acetic acid, citric acid, trifluro acetic acid, succinic acid, salicylic acid, and the like, and which acids are, in embodiments, used in a diluted form in the range of about 0.5 to about 10 weight percent by weight of water, or in the range of about 0.7 to about 5 weight percent by weight of water.

In embodiments, a naphthalene sulphonic acid polymeric surfactant is selected.

Toner Preparation.

In embodiments, the present toners are prepared by emulsion aggregation (EA) processes, such as by a process that includes aggregating a mixture of one or more emulsions, in embodiments, each emulsion comprising a resin; in embodiments, an emulsion including a combination of resins; in embodiments an emulsion comprising a first amorphous polyester; an emulsion comprising a second amorphous polyester; an emulsion comprising a crystalline polyester; an emulsion comprising a paraffin wax; an emulsion comprising a polymethylene wax; a pigment dispersion; and then coalescing the mixture. In embodiments, a crystalline polyester is provided in a separate emulsion. In embodiments, the crystalline polyester comprises C10:C9 polyester. The first amorphous polyester and the second amorphous polyester may be utilized as separate aqueous dispersions. In embodiments, a latex comprising the first amorphous polyester, the second amorphous polyester, and the crystalline polyester is used.

In embodiments, a process herein comprises combining a first wax; a second wax that is different from the first wax; wherein the first wax comprises a paraffin wax; wherein the second wax comprises a polymethylene wax; at least one polyester; and an optional colorant; aggregating to form aggregated particles; optionally adding a shell resin to form core-shell particles, and coalescing to form coalesced toner particles.

In embodiments, a process herein comprises combining a first amorphous polyester, a second amorphous polyester, wherein the first amorphous polyester and the second amorphous polyester are different, water, a paraffin wax; a polymethylene wax; a crystalline polyester; and a colorant to prepare a latex; optionally, adding an aggregating agent to the latex; heating the latex to form aggregated particles; adding a shell resin to the aggregated toner particles, the shell comprising at least one amorphous polyester; and heating to coalesce the particles forming coalesced toner particles; and recovering the coalesced toner particles.

In embodiments, the process herein further comprises adding a third amorphous polyester and a fourth amorphous polyester prior to aggregating; wherein the third amorphous polyester; wherein the third amorphous polyester and the fourth amorphous polyester are different. In embodiments, the third amorphous polyester is a poly(propoxylated bisphenol-co-terephthalate-fumarate-dodecenylsuccinate) and the fourth amorphous polyester is a poly(propoxylated-ethoxylated bisphenol-co-terephthalate-dodecenylsuccinate-trimellitic anhydride).

The mixture may be homogenized which may be accomplished by any suitable or desired process, such as by mixing at about 600 to about 6,000 revolutions per minute. Homogenization may be accomplished by any suitable means, including, for example, with an IKA ULTRA TURRAX TSO probe homogenizer.

Following the preparation of the above mixture, an aggregating agent may be added to the mixture. Alternately, the crystalline polyester may be added to one or both of the amorphous polyester-containing latexes. Any suitable aggregating agent may be utilized. Suitable aggregating agents include, for example, aqueous solutions of a divalent agent may be, for example, an inorganic cationic aggregating agent such as a polyaluminum halide such as polyaluminum chloride (PAC), or the corresponding bromide, fluoride, or iodide; a polyaluminum silicate such as polyaluminum sulfosilicate (PASS); or a water soluble metal salt including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, and copper sulfate; or combinations thereof. The aggregating agent may be added to the mixture at a temperature that is below the glass transition temperature (To of the resin (s). The aggregating agent may be added to the mixture under homogenization.

The aggregating agent may be added to the mixture in any suitable or desired amount, in embodiments, in an amount of, for example, from about 0% to about 10% by weight of the resin, from about 0.2% to about 8% by weight of the resin, or from about 0.5% to about 5% by weight of the resin.

The particles of the mixture may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for volume average particle size. The aggregation thus may proceed by maintaining an elevated temperature, or slowly raising the temperature to, for example, in embodiments, from about 30° C. to about 100° C., in embodiments from about 30° C. to about 80° C., or in embodiments from about 30° C. to about 50° C. The temperature may be held for a period time of from about 0.5 hours to about 6 hours, or in embodiments from about hour 1 to about 5 hours, while stirring, to provide the aggregated particles. Once the predetermined desired particle size is reached, a shell may be added. The volume average particle size of the particles prior to application of a shell may be, for example, from about 3 micrometers (μm) to about 10 μm, in embodiments, from about 4 μm to about 9 μm, or from about 6 μm to about 8 μm.

Shell Resin.

As described herein, the toner may comprise a core-shell configuration. After aggregation, but prior to coalescence, a resin coating may be applied to the aggregated particles to form a shell thereover. Any of the resins described above may be utilized in the shell. In embodiments, an amorphous polyester resin is utilized in the shell. In embodiments, the shell comprises a first amorphous polyester and a second amorphous polyester. In embodiments, the shell comprises a first amorphous polyester and a second amorphous polyester and is free of other resins. In embodiments, two amorphous polyester resins are utilized in the shell, e.g., in substantially equal amounts. In embodiments, a crystalline polyester resin and two different types of amorphous polyester resins are utilized in the core and the same two types of amorphous polyester resins are utilized in the shell.

In certain embodiments, the toner compositions herein comprise polyester toner compositions and are free of other types of resins, in embodiments, free of styrene, acrylate, or other resins.

In certain embodiments, the shell comprises a first amorphous polyester comprising a poly(propoxylated bisphenol-co-terephthalate-fumarate-dodecenylsuccinate) and a second amorphous polyester comprising a poly(propoxylated-ethoxylated bisphenol-co-terephthalate-dodecenylsuccinate-trimellitic anhydride).

The shell may be applied to the aggregated particles by using the shell resins in the form of emulsion(s) as described above. Such emulsions may be combined with the aggregated particles under conditions sufficient to form a coating over the aggregated particles. For example, the formation of the shell over the aggregated particles may occur while heating to a temperature of from about 30° C. to about 80° C. or from about 35° C. to about 70° C. The formation of the shell may take place for a period of time from about 5 minutes to about 10 hours or from about 10 minutes to about 5 hours.

Once the desired size of the toner particles is achieved, the pH of the mixture may be adjusted with a pH control agent, a base, to a value of from about 3 to about 10, or in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, a chelating agent such as ethylene diamine tetraacetic acid (EDTA) may be added to help adjust the pH to the desired values noted above. Other chelating agents may be used.

In embodiments, the size of the core-shell toner particles (prior to coalescence) may be from about 3 μm to about 10 μm, from about 4 μm to about 10 μm, or from about 6 μm to about 9 μm.

Coalescence.

Following aggregation to the desired particle size and application of the shell, the particles may then be coalesced to the desired final shape, the coalescence being achieved by, for example, heating the mixture to a temperature of from about 45° C. to about 150° C., from about 55° C. to about 99° C., or about 60° C. to about 90° C., which may be at or above the glass transition temperature of the resins utilized to form the toner particles. Heating may continue or the pH of the mixture may be adjusted (e.g., reduced) over a period of time to reach the desired circularity. The period of time may be from about 1 hours to about 5 hours or from about 2 hours to about 4 hours. Various buffers may be used during coalescence. The total time period for coalescence may be from about 1 to about 9 hours, from about 1 to about 8 hours, or from about 1 to about 5 hours. Stirring may be utilized during coalescence, for example, from about 20 rpm to about 1000 rpm or from about 30 rpm to about 800 rpm.

After aggregation and/or coalescence, the mixture may be cooled to room temperature. The cooling may be rapid or slow, as desired. A suitable cooling process may include introducing cold water to a jacket around the reactor. After cooling, the toner particles may be screened with a sieve of a desired size, filtered, washed with water, and then dried. Drying may be accomplished by any suitable process for drying including, for example, freeze-drying.

Toner Characteristics.

In embodiments, the dry toner particles, exclusive of external surface additives, exhibit one or more of the following characteristics:

(1) Volume average particle size of from about 5.0 μm to about 10.0 μm, from about 5.0 μm to about 9.0 μm, or from about 5.0 μm to about 7.0 μm.

(2) Number Average Geometric Size Distribution (GSDn) and/or Volume Average Geometric Size Distribution (GSDv) of from about 1.05 to about 1.55, from about 1.10 to about 1.40, or from about 1.10 to about 1.35.

(3) Circularity of from about 0.90 to about 1.00, from about 0.92 to about 0.99, or from about 0.95 to about 0.98.

These characteristics may be measured according to the techniques described in the Example, below, or according to techniques as known to those of skill in the art.

The present toners may possess excellent charging characteristics under a variety of relative humidity (RH) conditions, for example, a low-humidity zone (J-zone) of 21.1° C./10% RH and a high humidity zone (A-zone) of about 28° C./85% RH. Similarly, the present toners may possess excellent flow and blocking characteristics. In embodiments, the toner particles, exclusive of external surface additives, exhibit one or more of the following characteristics:

(4) A-zone charge per mass ratio (Q/M) of from about 1 μC/g to about 20 μC/g from about 5 μC/g to about 15 μC/g, or from about 10 μC/g to about 15 C/g.

(5) J-zone charge per mass ratio (Q/M) of from about 40 μC/g to about 80 μC/g, from about 40 μC/g to about 70 μC/g, or from about 50 μC/g to about 70 μC/g.

In embodiments, the toner particles, inclusive of external surface additives, exhibit one or more of the following characteristics:

(6) Dielectric loss (×1000) in the range of from about 20 to about 40, from about 22 to about 38, or from about 23 to about 35.

The present toners may possess excellent fusing characteristics as reflected by one or more of the following: gloss temperature to reach a gloss of 40, peak gloss, cold offset temperature, hot offset temperature, and minimum fix temperature (MFT). In embodiments, the toner particles, inclusive of external surface additives, exhibit a MFT of no more than about 130° C., no more than about 128° C., no more than about 127° C., or a MFT in the range of about 120° C. to about 130° C.

Developers and Carriers.

The present toners may be formulated into a developer composition. Developer compositions can be prepared by mixing the toners of the present disclosure with known carrier particles, including coated carriers, such as steel, ferrites, and the like. Such carriers include those disclosed in U.S. Pat. Nos. 4,937,166 and 4,935,326, the entire disclosures of each of which are incorporated herein by reference.

The toners may be present in the carrier in amounts of from about 1% to about 15% by weight, from about 2% to about 8% by weight, or from about 4% to about 6% by weight. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Applications.

The present toners may be used in a variety of xerographic processes and with a variety of xerographic printers. A xerographic imaging process includes, for example, preparing an image with a xerographic printer comprising a charging component, an imaging component, a photoconductive component, a developing component, a transfer component, and a fusing component. In embodiments, the development component may include a developer prepared by mixing a carrier with any of the toners described herein. The xerographic printer may be a high speed printer, a black and white high speed printer, a color printer, and the like. Once the image is formed with the toners/developers, the image may then be transferred to an image receiving medium such as paper and the like. Fuser roll members may be used to fuse the toner to the image-receiving medium by using heat and pressure. Use of the present toners with a xerographic printing process can provide printed images having the characteristics described herein and other desirable characteristics.

The present toners find use in other applications such as powder coating applications in which a powder spray gun (e.g., a tribo gun) containing any of the present toners is used to deliver the toner to a substrate.

In embodiments, a process herein comprises forming an image with the toner described herein using a xerographic printer; transferring the image comprising the toner to an image receiving medium; and fusing the toner to the image receiving medium to form a toner image.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Toner particles were prepared using an emulsion aggregation-coalescence process as follows.

Core polyester latex, pigment, waxes, and deionized water, were mixed in a reactor. pH was adjusted to 4.2 using nitric acid solution.

Flocculant was added and slurry was homogenized.

The mixture was heated to between 45-50° C. for aggregation. Particle size (D50v) was monitored using Coulter Multisizer-3 instrument.

At D50v of about 4.9-5.1 (micrometers) μm, shell latex was added to the mixture using a metered pump in order to achieve a D50v of about 5.8 to 6.0 μm.

The reaction was stopped by addition of sodium hydroxide solution and a chelating agent to increase the pH to about 7.8-8.2.

The mixture was heated to 85-90° C. for coalescence. Sodium hydroxide solution was slowly added to slurry during ramp-up in order to maintain pH 7.8-8.2.

The mixture was held at coalescence and the circularity was monitored using an FPIA Sysmex3000 instrument. In some embodiments during coalescence, the pH was lowered by the addition of an acid, such as nitric acid solution, in order to increase the rate of coalescence.

Once a circularity of about 0.972 was achieved, the mixture was passed through a heat exchanger to quickly lower the temperature below the Tg of the toner.

The toner was then filtered, washed, and dried using typical methods.

Five runs were carried out to quantify the characteristics of different wax formulations as shown in Table 1.

TABLE 1

| Example | Particle % Total Wax | % of Wax Being Paraffin | Particle % Polymethylene | Particle % Paraffin |
|---|---|---|---|---|
| 1 | 9.0 | 25 | 6.75 | 2.25 |
| 2 | 9.0 | 75 | 2.25 | 6.75 |
| 3 | 12.0 | 25 | 9.00 | 3.00 |
| 4 | 12.0 | 75 | 3.00 | 9.00 |
| 5 | 10.5 | 50 | 5.25 | 5.25 |

From the results, it can be seen that hot offset was significantly affected by the total amount of wax, and, to a lesser extent, the type of wax used. Compared to Comparative Toner A, each of the example toners showed an improvement in hot offset.

Thus, the present toner compositions employing a dual wax including paraffin wax and polymethylene wax provided improved hot offset over prior toners. The present toners also met the ultra-fine particle (UFP) emission target.

Examples 6-9

Examples 6, 7, 8, and 9 comprising cyan, magenta, yellow, and black toner, respectively, were prepared according to the process for Examples 1-5 above, except for having the composition as shown in Table 2.

TABLE 2

| Particle Formulation | Component | Example 6 Cyan Amount (wt % in particle) | Example 7 Magenta Amount (wt % in particle) | Example 8 Yellow Amount (wt % in particle) | Example 9 Black Amount (wt % in particle) |
|---|---|---|---|---|---|
| Particle Core | Low Mw APE | 26 | 25 | 26 | 24 |
| | High Mw APE | 26 | 25 | 26 | 24 |
| | Crystalline Polyester (C10C9) | 6.8 | 6.7 | 6.8 | 6.7 |
| | Polymethylene Wax | 2.25 | 2.25 | 2.25 | 2.25 |
| | Paraffin Wax | 6.75 | 6.75 | 6.75 | 6.75 |
| | Cyan Pigment PB15:3 | 5.5 | | | 1.0 |
| | Magenta Pigment PR269 | | 5.6 | | |
| | Magenta Pigment RE05 | | 1.4 | | |
| | Yellow Pigment PY74 | | | 5.5 | |
| | Carbon Black Nipex35 | | | | 6.9 |
| Particle Shell | Low Mw APE | 14 | 14 | 14 | 14 |
| | High Mw APE | 14 | 14 | 14 | 14 |

Examples 10-11

Examples 10 and 11 comprising yellow toner were prepared according to the process for Examples 1-5 above, except for having the composition as shown in Table 3.

TABLE 3

| Particle Formulation | Component | Example 10 Yellow Amount (wt % in particle) | Example 11 Yellow Amount (wt % in particle) |
|---|---|---|---|
| Particle Core | Low Mw APE | 25 | 25 |
| | High Mw APE | 25 | 25 |
| | Crystalline Polyester (C10C9) | 6.8 | 6.8 |
| | Polymethylene Wax | 2.25 | 2.25 |
| | Paraffin Wax | 6.75 | 6.75 |
| | Yellow Pigment PY74 | 5.5 | 6.0 |
| Particle Shell | Low Mw APE | 14 | 14 |
| | High Mw APE | 14 | 14 |

Toner data was obtained by wet deposition of the toner, followed by analysis using an X-Rite Spectrodensitometer.

Comparative Toner A was prepared having the same components as Example 1, except for containing only polymethylene wax in an amount of 9%.

Table 4 shows hot offset temperature results for Comparative Toner A and Examples 1-5.

TABLE 4

| Wax Formulation | Faint Hot Offset Temperature | Severe Hot Offset Temperature | |
|---|---|---|---|
| Comparative Toner A | 200° C. | 220° C. | 9.00% Polyethylene Wax |
| Example 1 | 210° C. | 215° C. | 6.75% Polyethylene Wax + 2.25% Paraffin |
| Example 2 | 220° C. | 230° C. | 2.25% Polyethylene Wax + 6.75% Paraffin |
| Example 3 | 230° C. | 240° C. | 5.25% Polyethylene Wax + 5.25% Paraffin |
| Example 4 | 220° C. | Not Observed | 9.00% Polyethylene |

TABLE 4-continued

| Wax Formulation | Faint Hot Offset Temperature | Severe Hot Offset Temperature | |
|---|---|---|---|
| Example 5 | 230° C. | Not Observed | Wax + 3.00% Paraffin 3.00% Polyethylene Wax + 9.00% Paraffin |

TABLE 5

| | C* at TMA = 0.25 | C* at TMA = 0.35 | C* at TMA = 0.45 | C* at TMA = 0.55 | C* at TMA = 0.65 | C* at TMA = 0.75 | C* at TMA = 0.85 | C* at TMA = 0.95 | C* at TMA = 1.00 | C* at TMA = 1.10 | |
|---|---|---|---|---|---|---|---|---|---|---|---|
| Example 2 | 104.72 | 114.26 | 117.4 | 119.34 | 119.75 | 120.59 | 121.43 | 121.84 | 122.24 | 122.38 | 6.5% PY74 |
| Example 10 | 99.43 | 109.18 | 113.78 | 116.35 | 117.42 | 118.64 | 119.44 | 120.07 | 120.42 | 120.82 | 5.5% PY74 |
| Example 11 | 100.99 | 110.77 | 114.75 | 117.34 | 118.34 | 119.37 | 120.17 | 120.77 | 121.07 | 121.41 | 6.0% PY74 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner composition comprising:

a first wax;

a second wax that is different from the first wax;

wherein the first wax comprises a paraffin wax;

wherein the second wax comprises a polymethylene wax;

at least one polyester; and an optional colorant;

wherein the toner composition is free of styrene and free of acrylate.

2. The toner composition of claim 1, wherein the toner composition comprises a total amount of wax including the first wax and the second wax in an amount of from about 9 to about 12 percent by weight based upon the total weight of the toner composition.

3. The toner composition of claim 1, wherein the paraffin wax is present in an amount of from about 25 to about 75 percent by weight based upon the total weight of the paraffin wax and the polymethylene wax.

4. The toner composition of claim 1, wherein the first wax comprises a paraffin wax having a peak melting point of from about 60 to about 80° C.

5. The toner composition of claim 1, wherein the first wax is a paraffin wax having a carbon/oxygen ratio of greater than about 50.

6. The toner composition of claim 1, wherein the first wax is a paraffin wax having a number-averaged molecular weight of from about 400 grams/mol to 600 grams/mol.

7. The toner composition of claim 1, wherein the second wax is a polymethylene wax having a number-averaged molecular weight of from about 600 grams/mol to 800 grams/mol.

8. The toner composition of claim 1, wherein the at least one polyester comprises at least one amorphous polyester and at least one crystalline polyester.

9. The toner composition of claim 1, wherein the at least one polyester comprises a first amorphous polyester and a second amorphous polyester that is different from the first amorphous polyester.

10. The toner composition of claim 1, wherein the toner composition comprises amorphous polyester present in an amount of from about 73 to about 78 percent by weight based upon the total weight of the toner composition.

11. The toner composition of claim 1, wherein the at least one polyester comprises a first amorphous polyester and a second amorphous polyester that is different from the first amorphous polyester, and a crystalline polyester.

12. The toner composition of claim 1, wherein the toner composition comprises crystalline polyester present in an amount of from about 6 to about 7 percent by weight based upon the total weight of the toner composition.

13. The toner composition of claim 1, further comprising a core-shell configuration;

wherein the core comprises at least one amorphous polyester and at least one crystalline polyester; and wherein the shell comprises at least one amorphous polyester.

14. The toner composition of claim 1, further comprising a core-shell configuration;

wherein the core comprises at least one amorphous polyester and at least one crystalline polyester; and wherein the shell comprises a first amorphous polyester and a second amorphous polyester that is different from the first amorphous polyester.

15. The toner composition of claim 1, further comprising a core-shell configuration;

wherein the core comprises a first amorphous polyester comprising a poly(propoxylated bisphenol-co-terephthalate-fumarate-dodecenylsuccinate) and a second amorphous polyester comprising a poly(propoxylated-ethoxylated bisphenol-co-terephthalate-dodecenylsuccinate-trimellitic anhydride).

16. The toner composition of claim 1, further comprising a core-shell configuration;

wherein the core comprises a crystalline polyester is of the formula

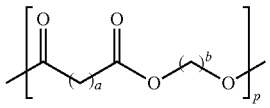

wherein each of a and b is in the range of from 1 to 12 and wherein p is in the range of from 10 to 100.

17. The toner composition of claim 1, wherein the optional colorant is present and wherein the colorant is selected from cyan, magenta, yellow, black, or a combination thereof.

18. The toner composition of claim 1, wherein the optional colorant is present and wherein the colorant comprises pigment present in an amount of from about 5 to about 8 percent by weight based upon the total weight of the toner composition.

19. The toner composition of claim 1, wherein the optional colorant is present and wherein the colorant comprises a combination of carbon black and cyan.

20. The toner composition of claim 1, further comprising a core-shell configuration;

wherein the shell comprises a resin and wherein the shell resin comprises about 28 percent by weight of the toner composition based upon the total weight of the toner composition including core and shell.

21. The toner composition of claim 1, wherein the second wax is a Fischer-Tropsch wax.

* * * * *